US010337535B2

(12) United States Patent
Buhl et al.

(10) Patent No.: US 10,337,535 B2
(45) Date of Patent: Jul. 2, 2019

(54) HYDRAULIC SYSTEM

(71) Applicant: miniBOOSTER HYDRAULICS A/S, Sonderborg (DK)

(72) Inventors: Jan Maiboll Buhl, Sonderborg (DK); Jorgen Mads Clausen, Sonderborg (DK); Christen Espersen, Augustenborg (DK); Leif Hansen, Sonderborg (DK); Jacob Madsen, Give (DK); Brian Petersen, Sonderborg (DK); Svend Erik Thomsen, Nordborg (DK); Jorgen P. Todsen, Nordborg (DK)

(73) Assignee: MiniBooster Hydraulics A/S, Sonderborg (DK)

( * ) Notice: Subject to any disclaimer, the term of this patent is extended or adjusted under 35 U.S.C. 154(b) by 667 days.

(21) Appl. No.: 14/221,563

(22) Filed: Mar. 21, 2014

(65) Prior Publication Data

US 2014/0283512 A1 Sep. 25, 2014

(30) Foreign Application Priority Data

Mar. 25, 2013 (EP) ..... 13001534

(51) Int. Cl.

| | |
|---|---|
| ***F15B 15/02*** | (2006.01) |
| ***F15B 3/00*** | (2006.01) |
| ***F15B 11/032*** | (2006.01) |

(52) U.S. Cl.

CPC ..... *F15B 15/02* (2013.01); *F15B 3/00* (2013.01); *F15B 11/032* (2013.01); *F15B 2211/20592* (2013.01); *F15B 2211/214* (2013.01); *F15B 2211/62* (2013.01); *F15B 2211/781* (2013.01)

(58) Field of Classification Search

CPC ..... F15B 3/00; F15B 11/032; F15B 11/0325; F15B 2211/214

See application file for complete search history.

(56) References Cited

U.S. PATENT DOCUMENTS 2,032,185 A * 2/1936 Sciaky ..... B30B 15/161 60/547.1
2,733,691 A * 2/1956 Johnson ..... B23Q 5/263 408/130
3,145,627 A * 8/1964 Neukom ..... B23K 11/04 60/533

(Continued)

FOREIGN PATENT DOCUMENTS

CN 101457775 A 6/2009
CN 101498324 A 8/2009

(Continued)

OTHER PUBLICATIONS

European Search Report for EP Serial No. 13 00 1534 dated Aug. 2, 2013.

*Primary Examiner* — Nathaniel E Wiehe
*Assistant Examiner* — Matthew Wiblin
(74) *Attorney, Agent, or Firm* — McCormick, Paulding & Huber LLP

(57) ABSTRACT

A hydraulic system (1) is provided comprising a pressure source (2), an output (3), and a pressure booster (6) arranged between the pressure source (2) and the output (3). The operational possibilities of such a system should be extended. To this end inactivating means are provided inactivating or activating said pressure booster.

20 Claims, 6 Drawing Sheets

(56) References Cited

U.S. PATENT DOCUMENTS

| | | | | |
|---|---|---|---|---|
| 3,693,702 | A * | 9/1972 | Piekenbrink | B22D 17/32 164/120 |
| 3,889,340 | A * | 6/1975 | Dixon, Jr. | F15B 3/00 60/452 |
| 4,152,921 | A * | 5/1979 | Dits | B21J 9/20 72/441 |
| 4,924,671 | A * | 5/1990 | Reinert | B30B 15/16 417/265 |
| 4,955,195 | A * | 9/1990 | Jones | E21B 34/16 137/1 |
| 6,279,370 | B1 | 8/2001 | Awad | |
| 6,581,379 | B2 * | 6/2003 | Nomura | B22D 17/203 60/563 |
| 7,686,596 | B2 | 3/2010 | Clausen et al. | |
| 7,726,950 | B2 | 6/2010 | Hansen et al. | |
| 2003/0056508 | A1 * | 3/2003 | Fan | B66F 3/42 60/479 |
| 2004/0258487 | A1 * | 12/2004 | Suilmann | E21D 23/16 405/294 |
| 2005/0178121 | A1 * | 8/2005 | Hansen | B23D 29/02 60/560 |
| 2011/0005221 | A1 | 1/2011 | Thelen et al. | |

FOREIGN PATENT DOCUMENTS

| | | | |
|---|---|---|---|
| CN | 102725541 | A | 10/2012 |
| DE | 10 2007 031 166 | A1 | 1/2009 |
| DE | 10 2009 035 278 | A1 | 2/2011 |
| EP | 2 249 994 | B1 | 3/2009 |
| EP | 3 002 465 | A1 | 4/2016 |
| WO | 2012 143614 | A1 | 10/2012 |
| WO | 2012142614 | A1 | 10/2012 |

* cited by examiner

HYDRAULIC SYSTEM

CROSS REFERENCE TO RELATED APPLICATION

Applicant hereby claims foreign priority benefits under U.S.C. § 119 from European Patent Application No. EP13001534.0 filed on Mar. 25, 2013, the contents of which are incorporated by reference herein.

TECHNICAL FIELD

The invention relates to a hydraulic system comprising a pressure source, an output, and a pressure booster arranged between the pressure source and the output.

BACKGROUND

Such a system is known from U.S. Pat. No. 7,686,596 B2.

The pressure source, e.g. a hydraulic pump, supplies hydraulic fluid under an elevated pressure. A hydraulic consumer connected to the output can be operated by means of this elevated hydraulic pressure.

In some applications the pressure supplied by the pressure source is not sufficient to operate the hydraulic consumer or the load connected to the output, so that a pressure booster is used to permanently amplify the pressure supplied by the pressure source. The pressure booster is a pressure amplifier increasing the pressure supplied to the output.

SUMMARY

The object underlying the invention is to extend the operational possibilities of a hydraulic system.

This object is solved in a hydraulic system mentioned above in that inactivating means are provided inactivating or activating said pressure booster.

Such a system can be operated with the pressure supplied by the pressure source alone, if this pressure is sufficient to operate a hydraulic consumer connected to the output, or it can be operated using the pressure booster, e.g. the pressure intensifier, to supply an elevated pressure to the output so that the consumer connected to the output can be supplied with a higher pressure. In such a system the pressure booster or pressure intensifier is activated only when required, i.e. the pressure booster is not "active" during normal operations. In this way it is possible to select a lower pressure or a higher pressure simply by using the inactivating means. In other words, the system is able to supply "pressure on demand".

Preferably said pressure booster is a hydraulic pressure booster. In a simple embodiment, such a hydraulic pressure booster can be realized by using a differential piston having a larger face which is loaded by the pressure of the pressure source, and an opposite smaller face generating the higher pressure. The ratio between the two faces basically determines the amplification factor of the hydraulic pressure booster.

Preferably said inactivating means are hydraulic means. This is a rather simple way to realize the inactivating means, since in a hydraulic system it is possible to use hydraulic means without increasing dramatically the construction or maintenance costs.

Preferably said inactivating means are at least in part arranged in parallel to said pressure booster, said inactivating means connecting a booster input and a booster output when inactivating said pressure booster. When said inactivating means inactivate said pressure booster, the pressure booster is short-circuited. In such a short-circuited situation the pressure booster requires almost no additional energy so that the system can be operated with a low energy consumption. If a higher pressure is required at the output, the short-circuit path parallel to the pressure booster is interrupted or fluttered, so that the elevated pressure generated by the pressure booster can be supplied to the output.

Alternatively or additionally said inactivating means are at least in part arranged in series with said pressure booster. In this way, supply of hydraulic fluid to said pressure booster can be interrupted.

Preferably said inactivating means are hydraulically operated. In a preferred embodiment, said inactivating means are realized by valve means, such valve means can easily be operated by a hydraulic pressure.

In this case it is preferred that said inactivating means are operated by means of a hydraulic signal line. The signal line can be used to transmit a hydraulic pressure from a signal generating position to the inactivating means. The signal producing position can be, for example, a switch or a valve operated by an operator.

However, it is preferred that said signal line is connected to a load depended position within said system. In this case the pressure booster can be activated depending on the pressure required, for example a load sensing pressure. When the pressure at the load depended position, e.g. at the output, signals that a higher pressure is required to operate the hydraulic consumer, for example to lift a heavy load, this pressure demand can automatically be transmitted to the inactivating means, said inactivating means activating said pressure booster. In this case no action of the operator is required. However, the hydraulic system can be used in an energy saving manner, when the pressure booster is inactive, or in a powerful operation, when the pressure booster is used to generate a higher pressure. However, the last named operation is performed only when necessary.

In another preferred embodiment said inactivating means are electrically operated. In some cases it is easier to use an electric signal line. The inactivating means can be realized by a magnetic or solenoid valve which is operated by an electric current. There are some possibilities to operate the inactivating means. A first possibility is to use an electric switch, which can, for example, be positioned at a joystick with which the operator controls the function of hydraulic consumer connected to the output. Another possibility would be to connect the signal line to a sensor sensing a pressure demand at the output or at the hydraulic consumer.

In a preferred embodiment said pressure booster and/or said inactivating means are integrated in said pressure source. In this way a pressure source is realized having basically two pressure levels, i.e. the "normal" level produced by the pressure source without pressure booster and an "elevated" pressure level produced by the pressure source with activated pressure booster.

In another or an additional embodiment said inactivating means are positioned near said output or are part of said output. In this way the elevated pressure is not loaded to the whole system, but only to parts of the system which require the higher pressure. In this way it is possible to dimension the hydraulic system to a lower overall pressure.

Preferably said system comprises at least two outputs, each output being connected to a branch, at least one branch being provided with a pressure booster and inactivating means. In this way it is possible to realize a hydraulic system having a part which is not loaded by the higher pressure generated by the hydraulic pressure booster, and a part which can be loaded by the higher pressure. This allows for a cheaper design of the hydraulic system.

Preferably said pressure booster comprises at least two amplification means, said amplification means being separately activateable. Such an embodiment is in particular useful when a larger flow or a larger pressure is required. In the first case, a pressure booster with several differential pistons can be used, for example 2, 4, 6, 8 or more pistons. These pistons can be activated at different intervals. When different pressures are required, it is possible to use different differential pistons having different ratios between the two active surfaces.

In a preferred embodiment said pressure booster is provided with means producing a variable booster pressure. In this way it is possible to use the full power of the pressure source and to add more or less power generated by said pressure booster. The means producing a variable booster pressure can be operated to adjust the pressure generated by the pressure booster depending on the load or the demand of the hydraulic consumer.

Preferably said pressure booster has a maximum amplification factor of 20 or less, in particular in the range of 1.2 to 20, preferably 1.5 to 4. When for ex-ample the amplification factor is 1.8, the pressure booster adds 80% of the pressure of the pressure source to the output pressure of the pressure source, so that the hydraulic system downstream the pressure booster is loaded with a pressure 1.8 times the pressure of the pressure source. Most hydraulic pressure systems are slightly over dimensioned, so that an "overpressure" does not adversely affect the hydraulic system. When this overpressure is supplied only for a short time, for example a few seconds, the hydraulic consumer can overcome a problematic working situation without time-consuming breaks in the working cycle and without exceeding the systems design-specifications.

In a preferred embodiment said pressure booster is provided with an auxiliary pump connected to said booster input, said auxiliary pump being connected to a driving motor which can be activated on demand. Such a unit comprising a pressure booster and an auxiliary pump is known, for example, from U.S. Pat. No. 7,726,950 B2. Such an embodiment allows "pressure on demand" on the lower end of the pressure range. Such an embodiment is in particular useful in situations in which the pressure of the pressure source decreases unintentionally. Such a pressure loss can occur, for example, in a vehicle in which the motor stops. In such a case the auxiliary pump can be used by activating the driving motor of the auxiliary pump. The auxiliary pump delivers hydraulic fluid under pressure to the booster input and therefore allows for a safe operation of the hydraulic consumers connected to the booster output. The activation of the driving motor can be performed by means of a switch or the like, actuated by a driver, or it can be performed automatically by means of a pressure sensor activating the driving motor when the pressure of the pressure source falls below a predetermined level.

BRIEF DESCRIPTION OF THE DRAWINGS

Preferred embodiments of the invention will now be described in more detail with reference to the drawing, wherein.

DETAILED DESCRIPTION

Figure 1:
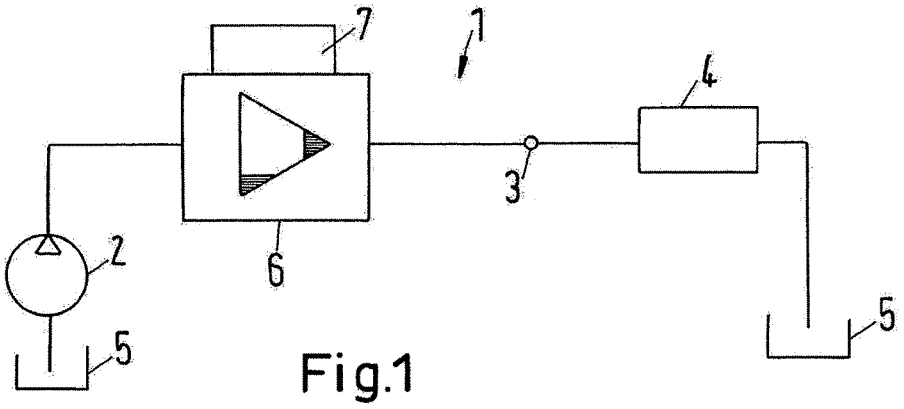
FIG. 1 shows a schematic illustration of a hydraulic system.

FIG. 1 schematically shows a hydraulic system 1 having a pressures source 2, for example a pump, and an output 3 which is connected or can be connected to a hydraulic consumer 4. The pressure source 2 takes hydraulic fluid out of a tank 5 (or any other reservoir) and pumps it with elevated pressure to the output 3 to supply the consumer 4. Hydraulic fluid returning from the consumer 4 returns to said tank 5.

In all Figs., the same numerals are used for the same or similar elements.

A pressure booster 6, i.e. a pressure intensifier, is arranged between said pressure source 2 and said output 3. The pressure booster 6 is a hydraulic pressure booster, e.g. a pressure booster comprising a differential piston as it is known in the art. A schematic illustration of such a booster 6 can be found in U.S. Pat. No. 7,686,596 B2. The differential piston has a first front face which is loaded by a pressure of said pressure source 2, and a second front face supplying hydraulic fluid to said output 3. The second front face is smaller than the first front face. The ratio between the two front faces determines the amplification factor of the pressure booster 6. However, the booster can of course have a different design.

In the present hydraulic system, the amplification factor of the pressure booster 6 is in the range from 1.2 to 20, e.g. the booster 6 adds 20% to 1900% to the output pressure of said pressure source 2.

The pressure booster 6 is not permanently active. In order to inactivate the pressure booster 6, inactivating means 7 are provided. Said inactivating means 7 are able to activate or inactivate said pressure booster 6. When said inactivating means 7 activate said pressure booster 6, the pressure at said output is higher than the pressure supplied by said pressure source alone. When said pressure booster 6 is not activated, the pressure at said output 3 corresponds to the pressure supplied by the said pressure source 2. The inactivating means 7 can be operated to activate said pressure booster 6 only when a higher pressure is needed at said output 3, in other words, a "pressure on demand" is provided.

Figure 2:
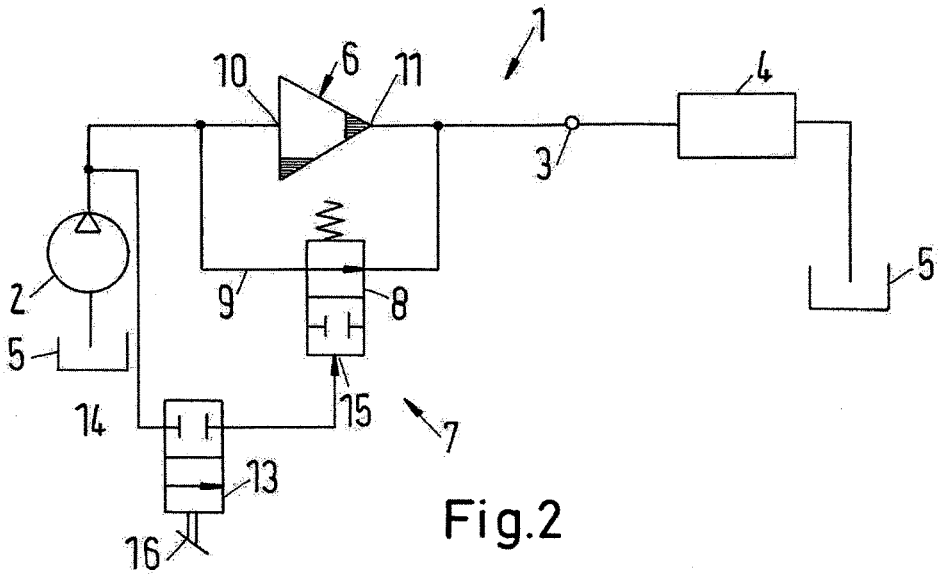
FIG. 2 shows the hydraulic system of FIG. 1 with more details.

FIG. 2 shows a first embodiment of said inactivating means 7. Said inactivating means 7 comprise hydraulic means, i.e. a valve 8, in particular a 2/2-way-valve, which is arranged in a line 9 connecting a booster input 10 and a booster output 11.

Said valve 8 is provided with a spring 12 shifting the valve 8 in the position shown in FIG. 2 establishing a short circuit between the booster input 10 and the booster output 11. In other words, said booster 6 is short-circuited and therefore inactive. The pressure from the pressure source 2 is supplied via line 9 to said output 3 and said consumer 4.

If said valve 8 is switched into the other position, the line 9 is interrupted so that the pressure booster 6 is active amplifying the pressure from said pressure source 2 so that the pressure at said output 3 is increased to 120% to 2000% of the pressure of said pressure source.

FIG. 2 shows a possibility for operating said valve 8. An actuating valve 13 is arranged in a signal line 14. Said signal line 14 is connected to the pressure source 2 and to a signal input 15 of said valve 8. The actuating valve 13 can be actuated by means of a button 16 which can be positioned, for example, at a joystick with which an operator operates the hydraulic system 1.

When the operator pushes the button 16 (or any other switch), the signal line 14 connects the pressure source 2 to the signal input 15 of said valve 8 shifting said valve 8 in a position in which the line 9 is interrupted so that the pressure booster 6 is active. As soon as the operator releases button 16, spring 12 pushes back valve 8 into a position in which line 9 short-circuits said pressure booster 6.

When for example the hydraulic consumer 4 is a hydraulic cylinder provided for lifting a load and the load is a bit too heavy for the working pressure supplied by the pressure source 2, the operator presses the button 16 for a few seconds to activate an 20% to 1900% higher force on the cylinder which enables him to continue operating effectively without time consuming breaks in the working cycle. Since the amplification factor of the pressure booster 6 is limited, such a short increase in pressure does not exceed the machines-design-specifications.

Figure 3:
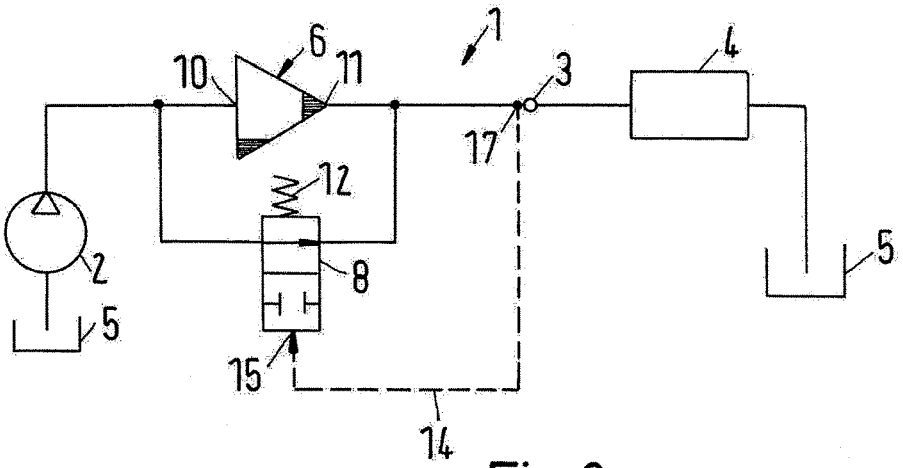
FIG. 3 shows an alternative embodiment to FIG. 1.

FIG. 3 shows another embodiment in which the same elements are designated with the same numerals.

In this embodiment, the signal line 14 for the valve 8 is connected to a point 17 positioned at or near said output 3, i.e. the signal line 14 signals a pressure at a load dependent position to said valve 8.

If the pressure at point 17 increases, for example due to a heavy load the signal line 14 transmit this elevated pressure to the signal input 15 of said valve 8 shifting it to a position in which said pressure booster 6 is activated to increase the pressure at the output 3. This activation of booster 6 is made automatically without requiring an action of the operator.

Figure 4:
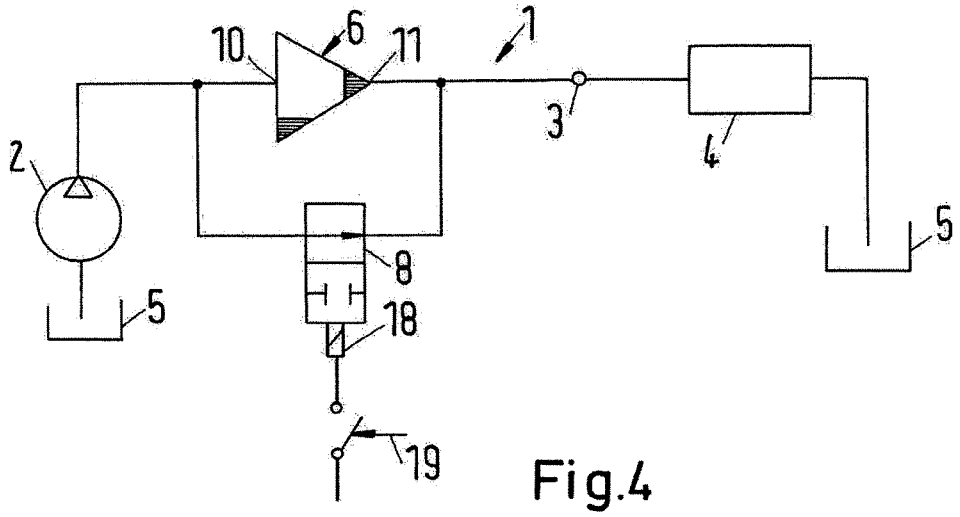
FIG. 4 shows a third embodiment of a hydraulic system.

FIG. 4 shows a third embodiment in which said valve 8 is actuated by means of a solenoid 18. The solenoid 18 is activated by switching a switch 19. Said switch 19 can be actuated by the operator. Said switch 19 can be, for example, be positioned at the above mentioned joystick with which the operator operates the hydraulic system 1.

Figure 5:
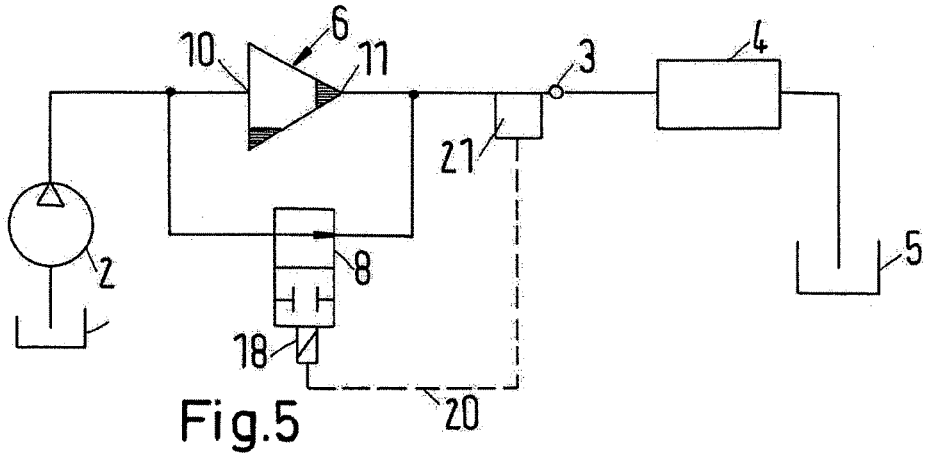
FIG. 5 shows a fourth embodiment of a hydraulic system.

FIG. 5 shows an fourth embodiment in which said valve 8 again is actuated by said solenoid 18. Said solenoid 18 is activated via a signal line 20 which is connected to sensor means 21 sensing a pressure at or near the output 3.

When the pressure at the output 3 increases due to a heavy load, this pressure demand is transmitted to said valve 8 activating said booster 6 which in turn supplies an increased pressure to said output 3.

Figure 6:
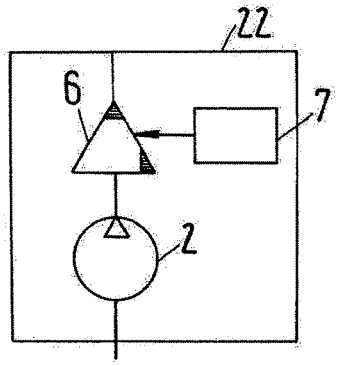
FIG. 6 shows a pressure source having an integrated booster and inactivating means.

FIG. 6 shows the possibility to integrate said pressure source 2 and said pressure booster 6 together with said inactivating means 7 in a common unit 22.

Figure 7:
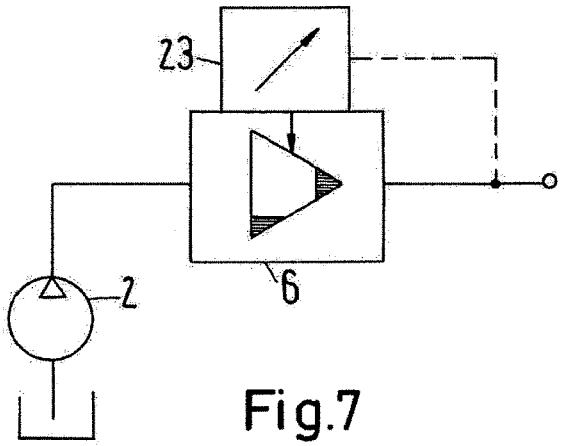
FIG. 7 shows a schematic illustration of a booster having a variable amplification factor, FIG. 8 schematically shows possible positions for a booster being provided with inactivating means.

FIG. 7 illustrates a further embodiment showing the possibility to provide said pressure booster 6 with means 23 producing a variable booster pressure.

In all hydraulic systems shown in FIGS. 1 to 7, the pressure booster 6 can be provided with an auxiliary pump connected to said booster input 10. Said auxiliary pump is connected to a driving motor which can be activated on demand. A unit showing a pressure booster, a pump and a driving motor which can be activated is shown, for example, in U.S. Pat. No. 7,726,950 B2, the disclosure of said document being incorporated by reference. Such an embodiment is useful when the pressure of the pump 2 falls below a level which is necessary for operating the consumers of the hydraulic system. If the pressure of the pump 2 falls below this level, the driving motor can be activated driving said auxiliary pump. The auxiliary pump delivers pressurised hydraulic fluid to the pressure booster 6 allowing for a sufficient operation of the consumers connected to the hydraulic system 1. Such an embodiment provides "pressure on demand" on the lower side of the pressure range.

Figure 8:
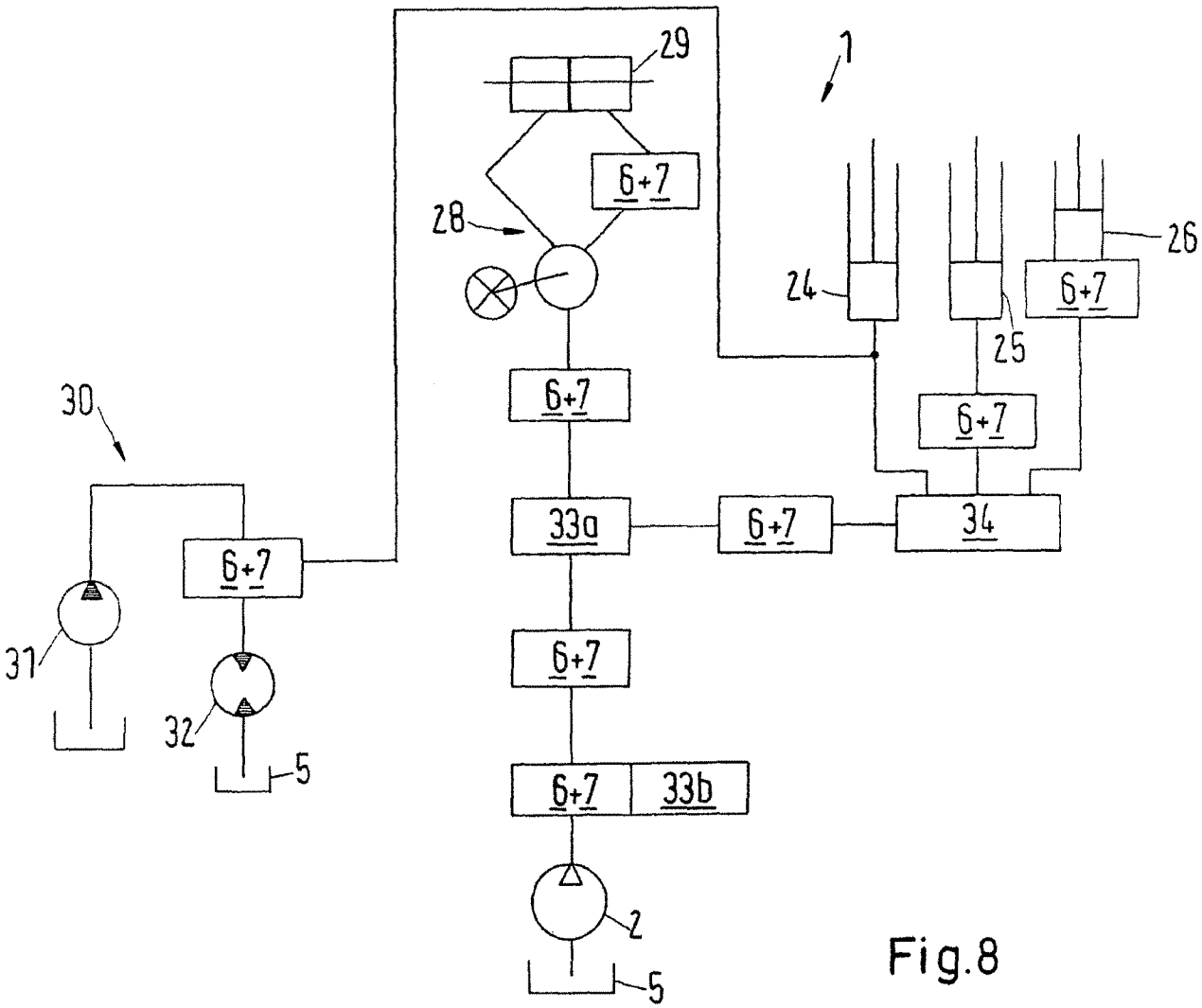

FIG. 8 shows a hydraulic system 1 having the above mentioned pressure source 2 and a plurality of consumers, i.e. a first cylinder 24, a second cylinder 25 and a third cylinder 26.

Another branch of the hydraulic system 1 comprises a steering unit 28 having a steering cylinder 29. Furthermore, a secondary system 30 is shown having a separate pressure source 31 and a consumer 32, e.g. a motor.

The hydraulic system 1 comprises a priority valve 33*a*, a pressure valve 33*b* and a distribution valve 34.

The hydraulic system 1 shown in FIG. 8 is used to illustrate a number of positions for the pressure booster 6 including said inactivating means 7. To illustrate this briefly boxes are shown marked with "6+7" so that is clear that each pressure booster 6 is provided with inactivating means 7.

Obviously, not all positions shown in FIG. 8 will be provided with a combination of pressure booster 6 and inactivating means 7. The illustration in FIG. 8 is merely used to show different possibilities.

As can be seen in FIG. 8, the unit of pressure booster 6 and inactivating means 7 (in the following briefly "unit") can be arranged directly downstream the pressure source 2 or it can be integrated into the pressure source 2.

Another possibility is to arrange the unit in a line downstream the pressure source 2, i.e. in a line between the pressure source 2 and said priority valve 33*a*.

Furthermore, it is possible to arrange the unit downstream a priority valve 33*a*, i.e. between the priority valve 33*a* and a consumer like said steering unit 28.

It is also possible to arrange said unit between said steering unit 28 and said steering cylinder 29. For the sake of clarity only one unit is shown. However, it is clear that said unit can supply the steering cylinder 29 for both directions.

Furthermore, it is possible to arrange said unit between said priority valve 33*a* and said distribution valve 34. The advantage of placing the pressure booster 6 before the distribution valve 34 (can be e.g. a proportional valve group) is that all valves (or consumers) connected to this distribution valve 34, i.e. belonging to the same group, can utilize the additional pressure generated by the pressure booster 6. The distribution valve 34 could be, e.g. PVG32 valves of the applicant, which have an LS output (LSa, LSb) "measuring" the pressure in both the A and the B connection, and this LS output could thus be used to activate/inactivate the booster, as later explained in connection with FIG. 11.

It is also possible to assign said unit to a hydraulic cylinder. An example is shown for the second cylinder 25. Here, the unit is positioned between the distribution valve 34 and the second cylinder 25.

Furthermore, it is possible, to integrate said unit and said third cylinder 26.

When said secondary system 30 is used, said unit can be used to increase the pressure of the secondary system 30 to the level of the pressure of the hydraulic system 1, if required. The general idea here is that, for example, a low pressure system 30 can be used that drives, for example, a fan. If a demand for a higher pressure occurs in a different hydraulic system 1, help can be given by means of an amplified pressure from the low-pressure system by means of a pressure booster 6. This connection could also be placed at another position, e.g. before the distribution valve 34.

In the embodiments shown in FIGS. 2 to 5 the valve 8 is shown to short-circuit said pressure booster 6, i.e. to close line 9. Said line 9 is already present in most pressure boosters 6, so that no additional line 9 is necessary.

However, in some cases it may be necessary not only to establish a through going line in parallel to said pressure booster 6, but to interrupt a connection between said line 9 and said booster input 10.

Figure 9:
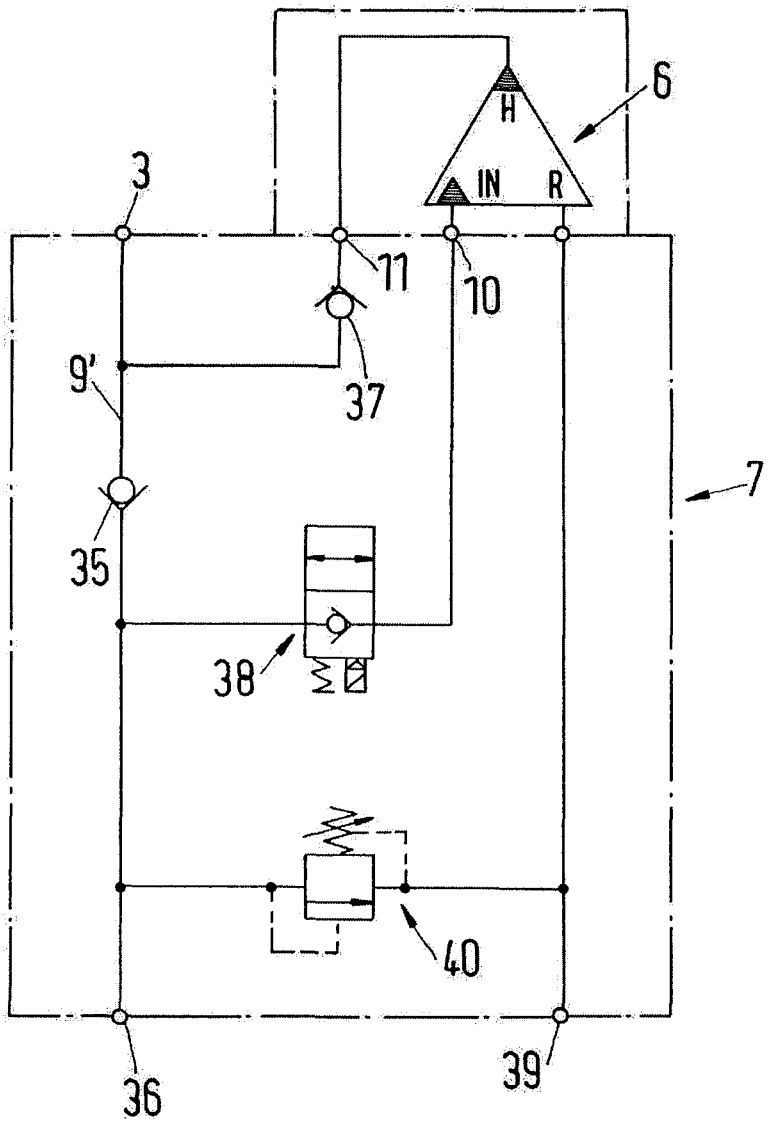
FIG. 9 shows a more detailed view of said inactivating means.

FIG. 9 shows a more detailed view of said inactivating means 7. The numerals used in FIGS. 1 to 8 designate the same elements.

In this embodiment line 9 comprises just a check valve 35 allowing a flow from an input connection 36 to be connected to the pressure source 2 and said output 3.

The booster output 11 is connected to said output 3 by means of another check valve 37.

The booster input 10 is connected to the connection 36 via a 2/2-way solenoid valve 38 which is shown in a position in which said pressure booster 6 is inactive since no fluid can flow from the connection 36 to the booster input 10. However, said solenoid valve 38 can be switched into another position in which fluid can flow from said connection 36 to said booster input 10.

Furthermore, FIG. 9 shows a tank connection 39 which is connected to a return connection R of said pressure booster 6.

Furthermore, a relief valve 40 is arranged between said two connections 36, 39.

Figure 10:
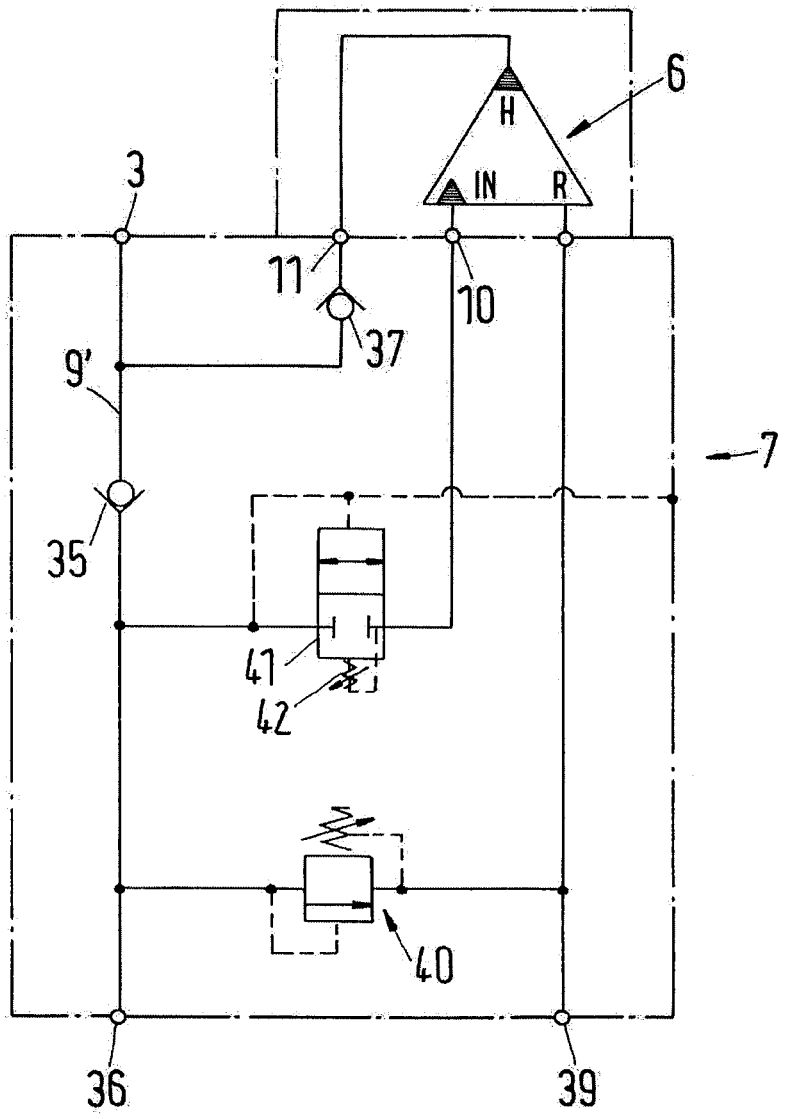
FIG. 10 shows another embodiment of said inactivating means.

FIG. 10 shows another embodiment of said inactivating means 7. In this embodiment said solenoid valve 38 is replaced by a sequence valve 41. Said sequence valve 41 again is a 2/2-way valve blocking a path between said input connection 36 and said booster input 10 in the position shown. This position is set by means of a spring 42.

The sequence valve 41 is loaded in the opposite direction by a pressure at the input connection 36. If this pressure increases to overcome the force of said spring 42, the sequence valve 41 is shifted into a position in which a part between said input connection 36 and said booster input 10 is established.

Figure 11:
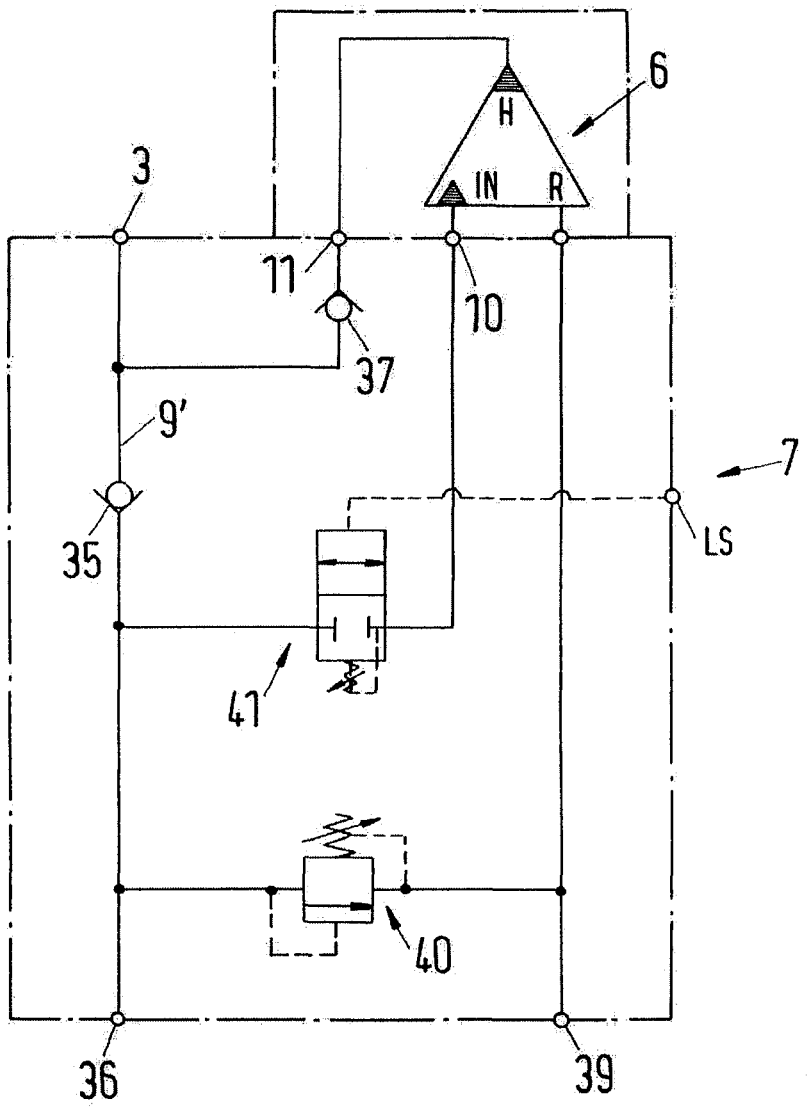
FIG. 11 shows a modification of the embodiment shown in FIG. 10.

FIG. 11 shows a modification of the embodiment shown in FIG. 10. However, in this embodiment the sequence valve 41 is actuated by a pressure at a load sensing connection LS.

Overall, this idea could be used to obtain a much better energy consideration for a vehicle or another working machine, as the pump of this vehicle or machine could have a smaller output, because the pressure booster can be included in the extreme loads.

While the present invention has been illustrated and described with respect to a particular embodiment thereof, it should be appreciated by those of ordinary skill in the art that various modifications to this invention may be made without departing from the spirit and scope of the present.

What is claimed is:

1. A hydraulic system comprising a pressure source, an output, and a pressure booster arranged between the pressure source and the output, wherein an inactivating valve is provided for inactivating or activating said pressure booster, wherein said inactivating valve is arranged in parallel to said pressure booster, said inactivating valve opening to connect a booster input and a booster output thereby inactivating said booster and closing to disconnect the booster input and the booster output when activating said booster, wherein when said booster is inactivated by said inactivating valve, the pressure at the output corresponds to a pressure supplied by the pressure source.

2. The hydraulic system according to claim 1, wherein said pressure booster is a hydraulic pressure booster.

3. The hydraulic system according to claim 2, wherein said inactivating valve is hydraulic means.

4. The hydraulic system according to claim 1, wherein said inactivating valve is hydraulic means.

5. The hydraulic system according to claim 1, wherein said inactivating valve is hydraulically operated.

6. The hydraulic system according to claim 5, wherein said inactivating valve is operated by means of a hydraulic signal line.

7. The hydraulic system according to claim 6, wherein said signal line is connected to a load dependent position within said system.

8. The hydraulic system according to claim 1, wherein said inactivating valve is electrically operated.

9. The hydraulic system according to claim 1, wherein pressure booster and/or said inactivating valve are integrated in said pressure source.

10. The hydraulic system according to claim 1, wherein said inactivating valve is positioned near said output or are part of said output.

11. The hydraulic system according to claim 1, wherein said system comprises at least two outputs, each output being connected to a branch, at least one branch being provided with the booster and inactivating valve.

12. The hydraulic system according to claim 1, wherein said booster comprises at least two amplification means, said amplification means being separately activatable.

13. The hydraulic system according to claim 1, wherein said booster is provided with means producing a variable booster pressure.

14. The hydraulic system according to claim 1, wherein said booster has a maximum amplification factor of 20 or less, in particular in a range of 1.2 to 20, preferably 1.5 to 4.

15. The hydraulic system according to claim 1, wherein said pressure booster is provided with an auxiliary pump connected to said booster input, said auxiliary pump being connected to a driving motor which can be activated on demand.

16. A hydraulic system comprising:

a pressure source, an output, a pressure booster arranged between the pressure source and the output, and an inactivating valve for inactivating or activating said pressure booster, wherein said inactivating valve opens to connect a booster input and a booster output thereby inactivating said booster and closes to disconnect the booster input and the booster output when activating said booster, wherein when said booster is inactivated by said inactivating valve, the pressure at the output corresponds to a pressure supplied by the pressure source.

17. The hydraulic system according to claim 16, wherein said inactivating valve is hydraulically operated.

18. The hydraulic system according to claim 16, wherein said inactivating valve is electrically operated.

19. The hydraulic system according to claim 16, wherein pressure booster and/or said inactivating valve are integrated in said pressure source.

20. The hydraulic system according to claim 16, wherein said system comprises at least two outputs, each output being connected to a branch, at least one branch being provided with the booster and inactivating valve.

* * * * *